US007887365B1

(12) United States Patent
Orner et al.

(10) Patent No.: US 7,887,365 B1
(45) Date of Patent: Feb. 15, 2011

(54) ELECTRICAL PLUG AND JACK ASSEMBLY

(75) Inventors: Jeffrey K. Orner, Boiling Springs, PA (US); Kevin E. Weidner, Hummelstown, PA (US); DaRon H. Wallace, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/507,640

(22) Filed: Jul. 22, 2009

(51) Int. Cl.
*H01R 9/05* (2006.01)

(52) U.S. Cl. ..... 439/585

(58) Field of Classification Search ..... 439/578, 439/582, 585, 877
See application file for complete search history.

(56) References Cited

U.S. PATENT DOCUMENTS 5,176,536 A * 1/1993 Ganger et al. ..... 439/582
6,648,684 B2 * 11/2003 Tang ..... 439/582
6,866,543 B2 * 3/2005 Chen et al. ..... 439/578
7,785,129 B2 * 8/2010 Chen ..... 439/352
7,794,275 B2 * 9/2010 Rodrigues ..... 439/584

OTHER PUBLICATIONS

Drawing No. C-619228, Customer Drawing for part No. 619228-1, Cable plug D IN 1.0/2.3 Series RG316 Cable Type, Tyco Electronics AMP GmbH, 1 page.
PN 3-1393670-6, catalog p. 132, Catalog 1307191, Tyco Electronics RF Coax Connectors, www.tycoelectronics.com, 22 pages.

* cited by examiner

*Primary Examiner*—Khiem Nguyen

(57) ABSTRACT

An electrical connector includes a housing and an outer electrical contact held by the housing. The outer electrical contact includes an interior cavity, a mounting end held by the housing, and a mating interface. The outer electrical contact is configured to mate with an electrical jack at the mating interface. A channel is defined between the housing and the outer electrical contact. A locking member is held within the channel between the housing and the outer electrical contact. The locking member is configured to engage the electrical jack. The electrical connector also includes an inner electrical contact having a mating end held within the interior cavity of the outer electrical contact. The outer electrical contact extends around the mating end of the inner electrical contact. The mating end of the inner electrical contact includes a receptacle configured to receive an inner mating contact of the electrical jack.

14 Claims, 5 Drawing Sheets

ELECTRICAL PLUG AND JACK ASSEMBLY

BACKGROUND OF THE INVENTION

The subject matter described and/or illustrated herein relates generally to electrical connector assemblies, and more particularly, to electrical plug and jack assemblies.

Electrical plug and jack assemblies are widely used to provide electrical connections between devices. For example, electrical plugs and electrical jacks are sometimes used for connecting to audio devices such as antennas, speakers, and/or the like. Electrical plugs and electrical jacks are also used, for example, for connecting computer equipment, network equipment, and/or video displays. Each of the electrical jacks includes one or more electrical contacts that mate with corresponding contact(s) of the electrical plugs. Due to the electrical nature of the jacks, each electrical jack includes the same type of contact(s) such that each electrical jack can be mated with any of the electrical plugs. One specific example of an electrical plug and electrical jack is a Deutsche Industrial Norms (DIN) 1.0/2.3 connector assembly. The electrical plugs and electrical jacks of DIN 1.0/2.3 connector assemblies are coaxial connectors that each includes an inner electrical contact and an outer electrical contact extending around the inner electrical contact. The inner electrical contact of the electrical plug of DIN 1.0/2.3 connectors is a pin that is received within a receptacle of the inner electrical contact of the electrical jack.

Systems that include electrical jacks and electrical plugs often include a large number of electrical jacks in close proximity to each other for connecting to a variety of different electrical devices. Because each electrical jack can be mated with any of the electrical plugs, it is possible to mate the electrical plug of an electrical device with the wrong electrical jack. Accordingly, the electrical device may be electrically connected to the wrong component of the system, sometimes referred to as a crossover connection. For example, the inner receptacle contact of DIN 1.0/2.3 jacks enables the DIN 1.0/2.3 jack to be mated with the inner pin contact of any DIN 1.0/2.3 plug. Accordingly, in systems where two or more DIN 1.0/2.3 jacks are located proximate each other, an electrical device may be electrically connected to the wrong component of the system by mating the DIN 1.0/2.3 plug of the electrical device with the wrong DIN 1.0/2.3 jack.

BRIEF DESCRIPTION OF THE INVENTION

In one embodiment, an electrical connector includes a housing and an outer electrical contact held by the housing. The outer electrical contact includes an interior cavity, a mounting end held by the housing, and a mating interface. The outer electrical contact is configured to mate with an electrical jack at the mating interface. A channel is defined between the housing and the outer electrical contact. A locking member is held within the channel between the housing and the outer electrical contact. The locking member is configured to engage the electrical jack. The electrical connector also includes an inner electrical contact having a mating end held within the interior cavity of the outer electrical contact. The outer electrical contact extends around the mating end of the inner electrical contact. The mating end of the inner electrical contact includes a receptacle configured to receive an inner mating contact of the electrical jack.

In another embodiment, an electrical connector includes a housing and an outer electrical contact held by the housing. The outer electrical contact includes an interior cavity, a mounting end held by the housing, and a mating interface.

The outer electrical contact is configured to mate with an electrical jack at the mating interface. A channel is defined between the housing and the outer electrical contact. A locking member is held within the channel between the housing and the outer electrical contact. The locking member is configured to engage the electrical jack. A compressible seal is held within the channel between the housing and the outer electrical contact. The compressible seal is configured to engage an outer mating contact of the electrical jack when the electrical connector and the electrical jack are mated together. The electrical connector also includes an inner electrical contact having a mating end held within the interior cavity of the outer electrical contact. The outer electrical contact extends around the mating end of the inner electrical contact.

In another embodiment, a connector assembly includes a mating connector having an inner mating contact and an outer mating contact extending around the inner mating contact. The mating connector also includes a compressible seal extending around the outer mating contact. The connector assembly also includes an electrical jack having an inner electrical contact and an outer electrical contact extending around the inner electrical contact. The outer electrical contact is engaged with the outer mating contact of the mating connector. The inner electrical contact is engaged with the inner mating contact of the mating connector. The outer electrical contact includes a front face engaged with the compressible seal of the mating connector.

DETAILED DESCRIPTION OF THE INVENTION

Figure 1:
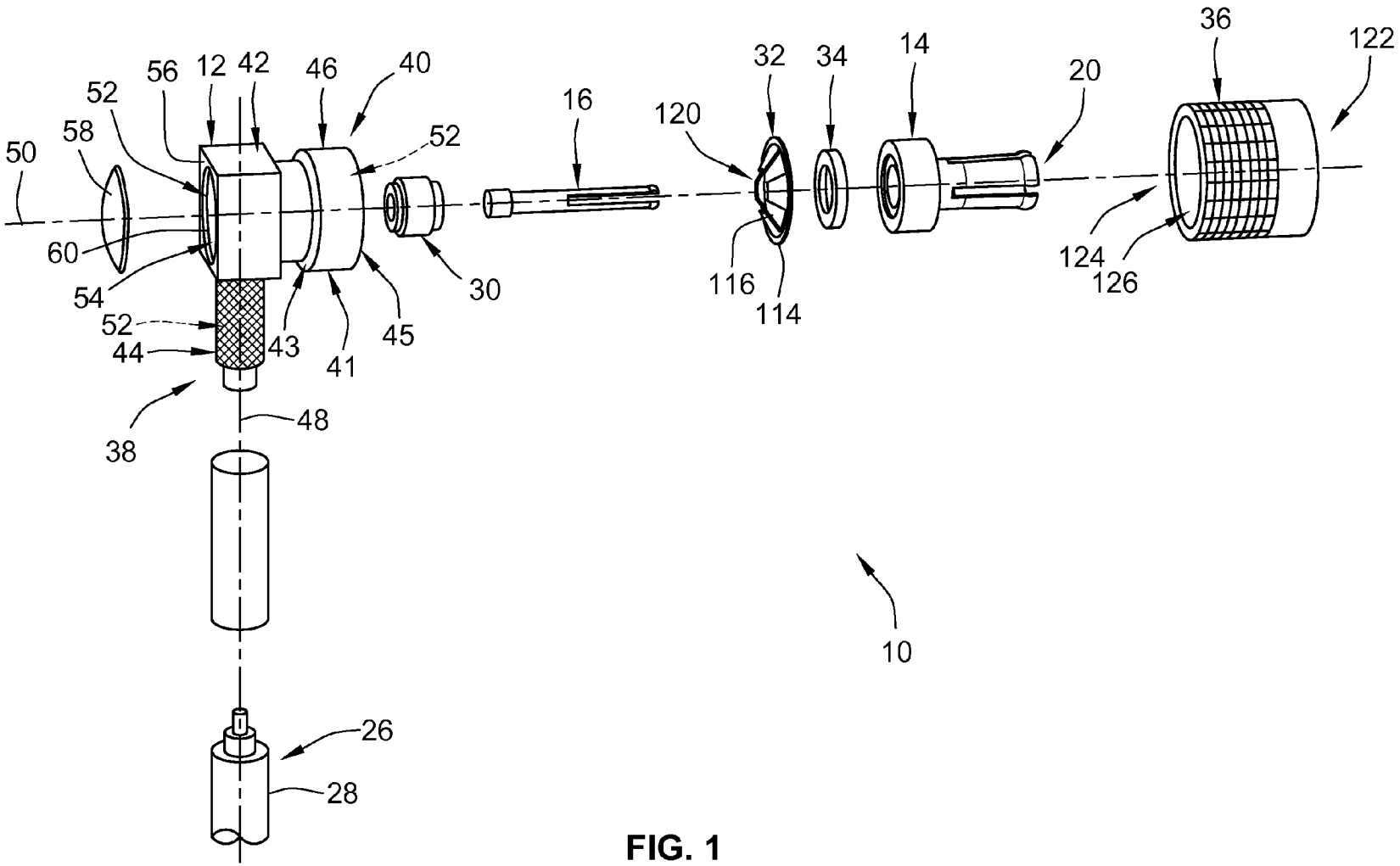
FIG. 1 is an exploded perspective view of an exemplary embodiment of an electrical plug.
Figure 2:
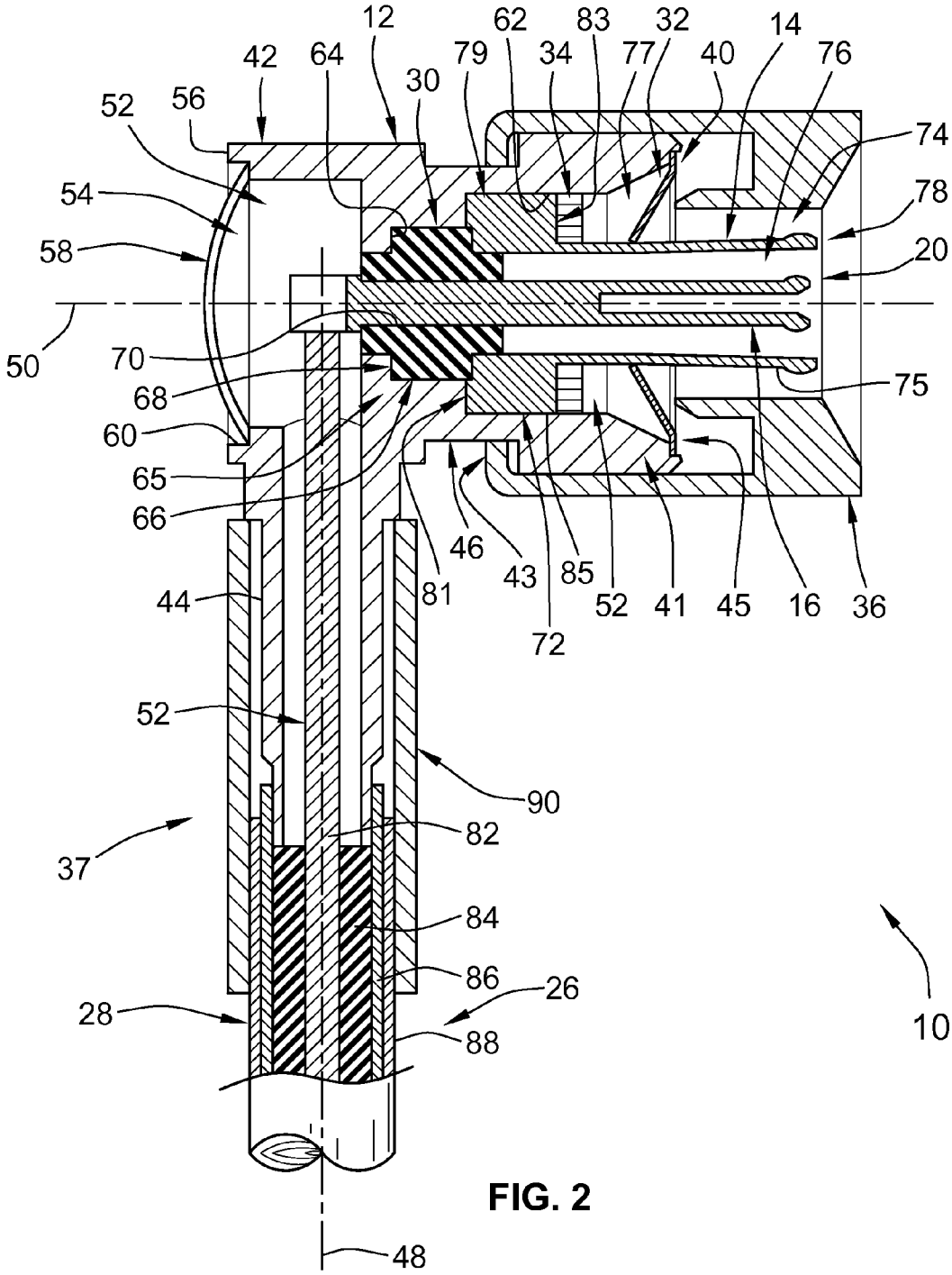
FIG. 2 is a cross-sectional view of the electrical plug shown in FIG. 1.

FIG. 1 is an exploded perspective view of an exemplary embodiment of an electrical plug 10. FIG. 2 is a cross-sectional view of the electrical plug 10. The electrical plug 10 includes an electrically conductive housing 12, an outer electrical contact 14, and an inner electrical contact 16. The electrical plug 10 is configured to be mated with an electrical jack 18 (FIGS. 4-6) at a mating interface 20. Specifically, when the electrical plug 10 is mated with the electrical jack 18, the outer electrical contact 14 of the electrical plug 10 is mated with, and thereby electrically connected to, an outer electrical contact 22 (FIGS. 4-6) of the electrical jack 18 at the mating interface 20. Similarly, the inner electrical contact 16 of the electrical plug 10 mates with, and thereby electrically connects to, an inner electrical contact 24 (FIGS. 4-6) of the electrical jack 18 at the mating interface 20. In some embodiments, the electrical plug 10 is similar to a Deutsche Industrial Norms (DIN) 1.0/2.3 connector. For example, in some embodiments, one or more dimensions of the inner electrical contact 16 and/or the outer electrical contact 14 are substantially similar to the inner electrical contact (not shown) and/or the outer electrical contact (not shown), respectively, of a DIN 1.0/2.3 connector. The electrical plug 10 may be referred to herein as an "electrical connector" and/or as a "mating connector". The inner electrical contact 16 and the outer electrical contact 14 may be referred to herein as an "inner mating contact" and an "outer mating contact", respectively.

In the exemplary embodiment, the electrical plug 10 terminates the end 26 of an electrical cable 28. Alternatively, the electrical plug 10 is mounted on a printed circuit (not shown). As used herein, the term "printed circuit" is intended to mean any electrical circuit in which the conducting connections have been printed or otherwise deposited in predetermined patterns on a dielectric substrate. The electrical plug 10 is optionally mounted within the opening (not shown) of a panel (not shown), whether or not the electrical plug 10 terminates an electrical cable 28 or is mounted on a printed circuit.

In addition to the housing 12, the outer electrical contact 14, and the inner electrical contact 16, the electrical plug 10 includes an insulating member 30, a locking member 32, a compressible seal 34, and a release collar 36. The housing 12 extends from an end 38 to an end 40. The housing 12 includes a base 42, a crimp barrel 44, and a contact barrel 46. The crimp barrel 44 includes the end 38 and extends outwardly from the housing base 42 along a central longitudinal axis 48. The contact barrel 46 includes the end 40 and extends outwardly from the housing base 42 along a central longitudinal axis 50. At the end 40, the contact barrel 46 includes a flange 41 for holding the release collar 36 on the contact barrel 46. The flange 41 includes a pair of opposite sides 43 and 45.

In the exemplary embodiment, a passageway 52 extends completely through the housing 12 from the end 38 to the end 40. Specifically, the passageway 52 extends through the end 38, the crimp barrel 44, the housing base 42, the contact barrel 46, and the end 40. An opening 54 optionally extends through a rear wall 56 of the housing base 42 into communication with the passageway 52. An optional cover 58 is provided for sealing the opening 54 within the rear wall 56 of the housing base 42. The cover 58 thereby seals the passageway 52 at the rear wall 56 of the housing base 42. In the exemplary embodiment, the rear wall 56 of the housing base 42 includes a groove 60 adjacent the opening 54. The cover 58 is received within the groove 60 in a snap-fit arrangement to secure the cover 58 to the housing base 42. In addition or alternatively to the snap-fit arrangement, the cover 58 may be secured to the housing base 42 using any method, arrangement, structure, means, and/or the like, such as, but not limited to, using an adhesive and/or the like.

Referring to FIG. 2, the base 42 and contact barrel 46 of the housing 12 include an interior wall 62 that defines a portion of the passageway 52. The interior wall 62 includes a shoulder 64. The insulating member 30 includes a dielectric body 65 having a flange 66 that defines a shoulder 68. A contact channel 70 extends through the length of the body 65 of the insulating member 30. The insulating member 30 is held within the passageway 52. Specifically, in the exemplary embodiment, the flange 66 of the insulating member 30 engages the interior wall 62 of the housing 12 in an interference-fit arrangement. The shoulder 68 of the insulating member 30 engages the shoulder 64 of the interior wall 62 of the housing 12 to locate the insulating member 30 along the longitudinal axis 50. The insulating member 30 may be held within the passageway 52 using any method, arrangement, structure, means, and/or the like in addition or alternative to the interference-fit arrangement, such as, but not limited to, using an adhesive and/or the like.

The outer electrical contact 14 extends a length from a mounting end 72 to a mating end 74. The mating end 74 includes a plurality of individual fingers 75 that define a portion of the mating interface 20 of the electrical plug 10. The outer electrical contact 14 includes an interior cavity 76 that extends through the length of the outer electrical contact 14. A channel 77 is defined between the outer electrical contact 14 and the interior wall 62 of the housing 12. The mounting end 72 of the outer electrical contact 14 is held by the interior wall 62 of the housing 12 such that the mating end 74 extends outwardly from the contact barrel 46 of the housing 12. The mounting end 72 of the outer electrical contact 14 is engaged with the interior wall 62 of the housing 12 such that the outer electrical contact 14 is electrically connected to the housing 12. Specifically, the mounting end 72 of the outer electrical contact 14 includes a mounting flange 79 having a pair of opposite sides 81 and 83 and a radially outer surface 85 extending from the side 81 to the side 83. The side 81 and the radially outer surface 85 of the mounting flange 79 engage the interior wall 62 of the housing 12.

In the exemplary embodiment, the mating end 74 of the outer electrical contact 14 defines a plug 78 that is configured to be received within a socket 80 (FIGS. 4-6) of the outer electrical contact 22 of the electrical jack 18. Alternatively, the mating end 74 of the outer electrical contact 14 defines a socket (not shown) that is configured to receive a plug (not shown) of the outer electrical contact 22 of the electrical jack 18.

The electrical cable 28 includes an inner electrical conductor 82, an insulator 84 surrounding the inner electrical conductor 82, an outer electrical conductor 86 surrounding the insulator 84, and a cable jacket 88 surrounding the outer electrical conductor 86. The outer electrical conductor 86 is engaged with the crimp barrel 44 such that the outer electrical conductor 86 is electrically connected to the crimp barrel 44. Accordingly, the outer electrical contact 14 is electrically connected to the outer electrical conductor 86 of the electrical cable 28 via the housing 12. An optional cable ferrule 90 surrounds the crimp barrel 44 and the cable jacket 88 to facilitate holding the electrical cable 28 on the crimp barrel 44.

Figure 3:
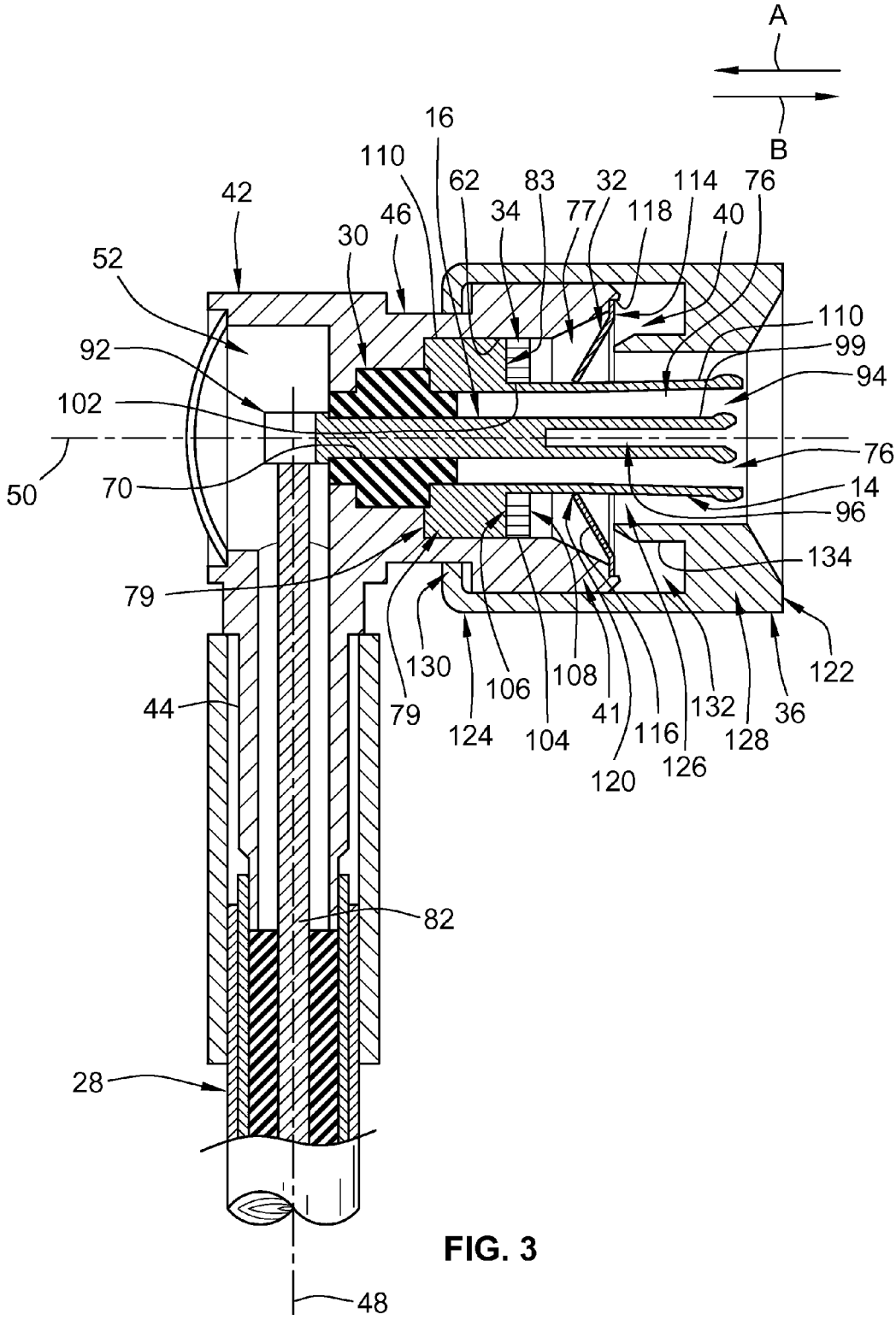
FIG. 3 is another cross-sectional view of the electrical plug shown in FIGS. 1 and 2 that is substantially similar to the cross section shown in FIG. 2.

FIG. 3 is another cross-sectional view of the electrical plug 10 that is substantially similar to the cross section shown in FIG. 2. The inner electrical contact 16 extends a length from a terminating end 92 to a mating end 94. The inner electrical contact 16 is held by the insulating member 30. Specifically, the inner electrical contact 16 is held within the contact channel 70 of the insulating member 30 such that the mating end 94 is held within the interior cavity 76 of the outer electrical contact 14. The outer electrical contact 14 thereby extends around the mating end 94 of the inner electrical contact 16. The insulating member 30 electrically insulates the inner electrical contact 16 from the outer electrical contact 14.

The mating end 94 of the inner electrical contact 16 includes a receptacle 96 that is configured to receive a pin 98 (FIGS. 5 and 6) of the inner electrical contact 24 of the electrical jack 18. In the exemplary embodiment, the receptacle 96 is defined by a plurality of individual fingers 99 that define a portion of the mating interface 20 of the electrical plug 10. However, the receptacle 96 may alternatively be defined by any other type of structure at the mating end 94 of the inner electrical contact 16. For example, in some alternative embodiments, the receptacle 96 is defined by a mating end 94 having a substantially unbroken circumference surrounding an opening, instead of the individual fingers 99.

The inner electrical contact 16 is held by the insulating member 30 such that the terminating end 92 extends outwardly from the insulating member 30 into the portion of the passageway 52 that extends within the housing base 42. The inner electrical conductor 82 of the electrical cable 28 extends through the portion of the passageway 52 extending within the crimp barrel 44 and into the portion of the passageway that extends within the housing base 42. The terminating end 92 of the inner electrical contact 16 is engaged with an end 100 of the inner electrical conductor 82 of the electrical cable 28 such that the inner electrical contact 16 is electrically connected to the inner electrical conductor 82.

The compressible seal 34 is held within the channel 77 defined between the outer electrical contact 14 and the interior wall 62 of the housing 12. The compressible seal 34 extends around a portion of the mating end 74 of the outer electrical contact 14. The compressible seal 34 includes a radially inner surface 102, a radially outer surface 104, and a pair of opposite sides 106 and 108 that extend from the radially inner surface 102 to the radially outer surface 104. The radially inner surface 102 of the compressible seal 34 is engaged with a radially outer surface 110 of the mating end 74 of the outer electrical contact 14, while the radially outer surface 104 is engaged with the interior wall 62 of the housing 12. The side 106 of the compressible seal 34 engages the side 83 of the mounting flange 79 of the outer electrical contact 14. The side 108 of the compressible seal 34 is configured to engage a front face 112 (FIGS. 5 and 6) of the outer electrical contact 22 of the electrical jack 18 to facilitate sealing the mating interface 20 when the electrical plug 10 and electrical jack 18 are mated together. The compressible seal 34 may be fabricated from any material(s) that enables the compressible seal 34 to facilitate sealing the mating interface 20 when the electrical plug 10 and electrical jack 18 are mated together, such as, but not limited to, rubber, silicone rubber, a polymer, and/or the like. In some embodiments, the compressible seal 34 facilitates providing an electrical plug 10 that is compliant with International Protection Rating 68 (IP68) for continuous immersion in water beyond one meter.

The locking member 32 is held within the channel 77 such that the locking member 32 extends around a portion of the mating end 74 of the outer electrical contact 14. The locking member 32 includes a base 114 and a plurality of resilient fingers 116 extending from the base 114. The resilient fingers 116 define a spring of the locking member 32. The base 114 is held within a groove 118 formed within the interior wall 62 of the contact barrel 46 at the end 40 thereof. In the exemplary embodiment, the base 114 of the locking member 32 is received within the groove 118 in a snap-fit arrangement to secure the base 114 to the interior wall 62 of the contact barrel 46. In addition or alternatively to the snap-fit arrangement, the base 114 may be secured to the interior wall 62 using any method, arrangement, structure, means, and/or the like, such as, but not limited to, using an adhesive and/or the like.

The fingers 116 extend radially inward from the base 114 such that the fingers 116 extend toward the radially outer surface 110 of the outer electrical contact 14. Each finger 116 extends from the base 114 to an end 120. When the electrical plug 10 is disengaged from the electrical jack 18 as shown in FIG. 2, the ends 120 of the fingers 116 engage the radially outer surface 110 of the outer electrical contact 14. The ends 120 of the fingers 116 are configured to engage the outer electrical contact 22 of the electrical jack 18 when the electrical plug 10 and the electrical jack 18 are mated together to facilitate locking the electrical plug 10 and the electrical jack 18 together.

The release collar 36 extends a length from an end 122 to an end 124. A passageway 126 extends through the length of the release collar 36. The ends 122 and 124 of the release collar 36 include respective flanges 128 and 130 that extend radially inward relative to the central longitudinal axis 50 of the contact barrel 46. The flanges 128 and 130 define a recess 132 therebetween. An actuating arm 134 extends from the flange 130 along the central longitudinal axis 50 and into the recess 132. The actuating arm is configured to engage the fingers 116 to deflect the ends 120 of the fingers 116 radially outwardly from the central longitudinal axis 50 toward the interior wall 62 of the contact barrel 46.

The release collar 36 is mounted on the contact barrel 46 such that the flange 41 of the contact barrel 46 is received within the recess 132. The release collar 36 is movable relative to the contact barrel 46 along the central longitudinal axis 50. Specifically, the release collar 36 is movable along the central longitudinal axis 50 from a locked position to an unlocked position. In the locked position shown in FIG. 2, the fingers 116 of the locking member 32 are not deflected by the actuating arm 134. Accordingly, when the electrical plug 10 is mated with the electrical jack 18 and the release collar 36 is in the locked position, the ends 120 of the locking member fingers 116 remain engaged with the outer electrical contact 22 of the electrical jack 18 to hold the electrical jack 18 and the electrical plug 10 together. To unlock the locking member 32, the release collar 36 is moved along the central longitudinal axis 50 in the direction A such that the actuating arm 134 deflects the ends 120 of the fingers 116 radially outwardly from the central longitudinal axis 50 toward the interior wall 62 of the contact barrel 46. The electrical plug 10 and the electrical jack 18 can then be disengaged. Contact between the flanges 128 and 130 of the release collar 36 and the sides 43 and 45, respectively, of the contact barrel flange 41 limit travel of the release collar 36 along the central longitudinal axis 50 in the respective directions B and A.

In the exemplary embodiment, the crimp barrel 44 and the contact barrel 46 extend outwardly from the base 42 at approximately a 90° angle relative to each other. Specifically, in the exemplary embodiment, the longitudinal axis 48 of the crimp barrel 44 extends perpendicular to the longitudinal axis 50 of the contact barrel 46. Accordingly, in the exemplary embodiment, the electrical plug 10 is a right-angle connector. Alternatively, the crimp barrel 44 and the contact barrel 46 may extend outwardly from the base 42 at any other angle than 90° relative to each other. For example, in some alternative embodiments, the longitudinal axis 48 of the crimp barrel 44 extends parallel to the longitudinal axis 50 of the contact barrel 46.

Figure 4:
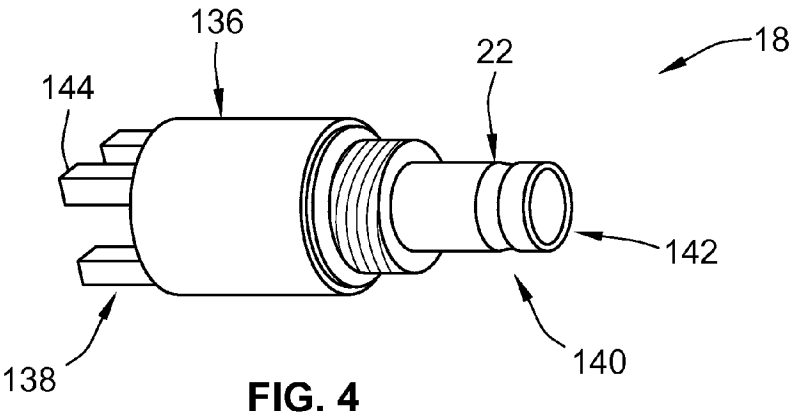
FIG. 4 is a perspective view of an exemplary embodiment of an electrical jack for mating with the electrical plug shown in FIGS. 1-3.
Figure 5:
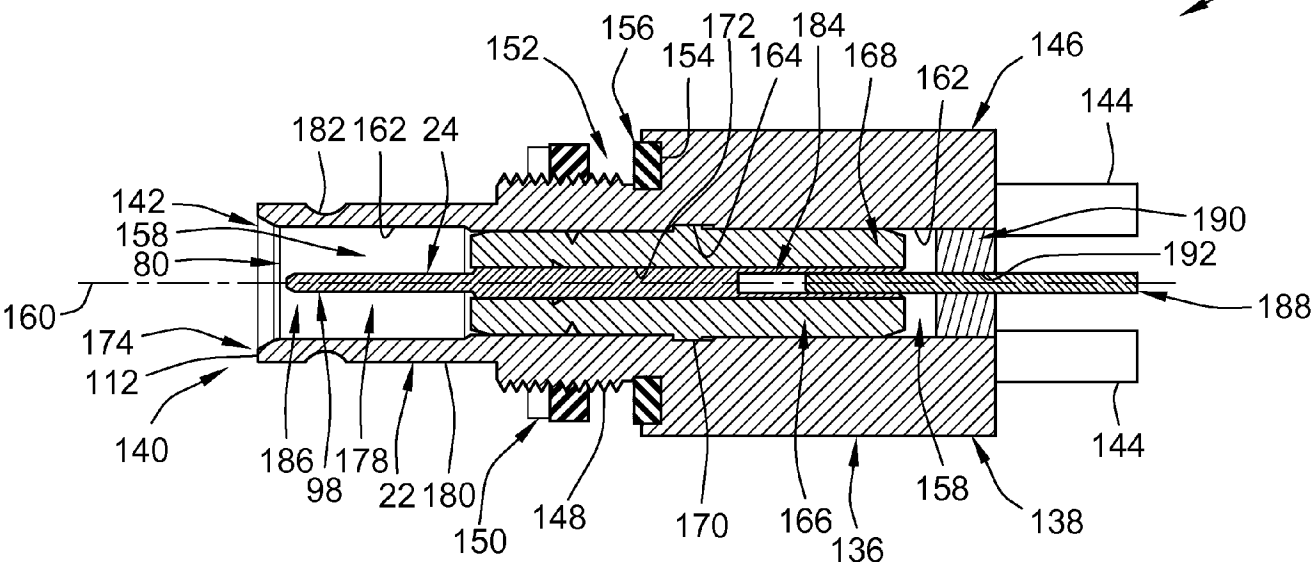
FIG. 5 is a cross-sectional view of the electrical jack shown in FIG. 4.
Figure 6:
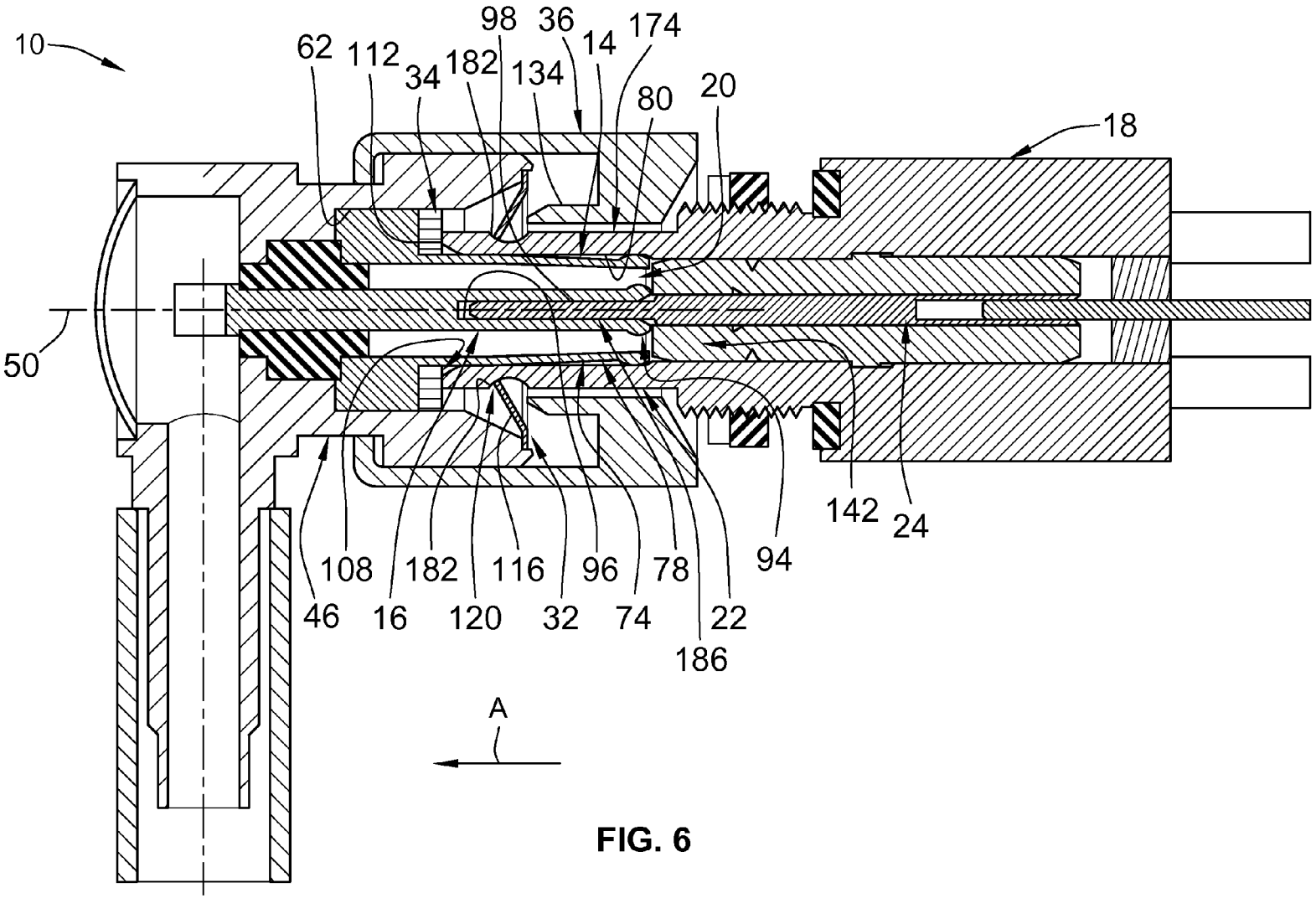
FIG. 6 is a cross-sectional view illustrating the electrical plug shown in FIGS. 1-3 mated with the electrical jack shown in FIGS. 4 and 5.

FIG. 4 is a perspective view of an exemplary embodiment of the electrical jack 18. The electrical jack 18 includes an electrically conductive housing 136 and the inner electrical contact 24 (FIGS. 5 and 6). The housing 136 extends a length from an end 138 to an end 140. The outer electrical contact 22 is defined by a portion of the housing 136 and includes the end 140 of the housing 136. The end 140 of the housing 136, and thus the outer electrical contact 22, includes a mating interface 142 along which the electrical jack 18 is configured to be mated with the electrical plug 10 (FIGS. 1, 2, and 5). In the exemplary embodiment, the end 138 of the housing 136 includes a plurality of mounting posts 144 for mounting the electrical jack 18 on a printed circuit (not shown). In some embodiments, the electrical jack 18 is similar to a Deutsche Industrial Norms (DIN) 1.0/2.3 connector. For example, in some embodiments, one or more dimensions of the inner electrical contact 24 and/or the outer electrical contact 22 are substantially similar to the inner electrical contact (not shown) and/or the outer electrical contact (not shown), respectively, of a DIN 1.0/2.3 connector. The electrical jack 18 may be referred to herein as an "electrical jack". The inner electrical contact 24 and the outer electrical contact 22 may be referred to herein as an "inner mating contact" and an "outer mating contact", respectively.

FIG. 5 is a cross-sectional view of the electrical jack 18. The housing 136 includes a base 146, an externally threaded barrel 148 extending from the base 146, and the outer electrical contact 22 extending from the threaded barrel 148. The base 146 includes the end 138 of the housing 136. As described above, in the exemplary embodiment, the electrical jack 18 includes a plurality of mounting posts 144 that extend from the base 146 at the end 138. The mounting posts 144 enable the housing 136 to be mounted on a printed circuit (not shown). Alternatively, the electrical jack 18 terminates the end (not shown) of an electrical cable (not shown). In the exemplary embodiment, the electrical jack 18 is optionally configured to be mounted within the opening (not shown) of a panel (not shown). Specifically, the housing 136 includes the threaded barrel 148. A nut 150 is threaded onto the threaded barrel 148 to define a recess 152 between the nut 150 and a side 152 of the base 146. A portion of the panel defining the panel opening is received within the recess 152 and the nut 150 is tightened relative to the side 152 of the base 146 to securely hold the panel between the nut 150 and the side 152 of the base 146. The side 152 of the base 146 optionally includes a groove 154 for receiving an optional compressible seal 156 therein. The compressible seal 156 facilitates sealing the panel to the housing 136. In some embodiments, the compressible seal 156 facilitates providing an electrical jack 18 that is compliant with IP68 for continuous immersion in water beyond one meter.

In the exemplary embodiment, a passageway 158 extends along a central longitudinal axis 160 completely through the length of the housing 136 from the end 138 to the end 140. Specifically, the passageway 158 extends through the end 138, the base 146, the threaded barrel 148, and the end 140. The housing 136 includes an interior wall 162 that defines the passageway 158. The interior wall 162 includes a recess 164. An insulating member 166 is received within the passageway 158. The insulating member 166 includes a dielectric body 168 having a flange 170. In the exemplary embodiment, the flange 170 of the insulating member 166 is received within the recess 164 of the interior wall 162 of the housing 136 to hold and locate the insulating member 166 within the passageway 158. The insulating member 166 may be held within the passageway 158 using any method, arrangement, structure, means, and/or the like in addition or alternative to cooperation between the flange 170 and the recess 164, such as, but not limited to, using an adhesive, and interference fit, and/or the like. A contact channel 172 extends through the length of the body 168 of the insulating member 166.

The outer electrical contact 22 extends a length from the threaded barrel 148 to a mating end 174. The mating end 174 defines the mating interface 142 of the electrical jack 18 and includes the end 140 of the housing 136. The mating end 174 also includes the front face 112. The passageway 158 within the housing 136 defines an interior cavity 178 that extends through the length of the outer electrical contact 22. The outer electrical contact 22 includes a radially outer surface 180 relative to the central longitudinal axis 160. The radially outer surface 180 includes a groove 182 that is configured to receive the ends 120 (FIGS. 1, 3, and 6) of the fingers 116 (FIGS. 1, 3, and 6) of the locking member 32 (FIGS. 1-3 and 6) to facilitate locking the electrical jack 18 and the electrical plug 10 together. When mounted on the printed circuit, the end 138 of the housing 136 engages one or more electrical traces (not shown) and/or one or more electrical contacts (not shown) such that the housing 136 is electrically connected to the printed circuit. Accordingly, the outer electrical contact 22 is electrically connected to the printed circuit via the housing 136.

In the exemplary embodiment, the mating end 174 of the outer electrical contact 22 defines the socket 80 that is configured to receive the plug 78 (FIGS. 2 and 6) of the outer electrical contact 14 (FIGS. 1-3 and 6) of the electrical plug 10. Alternatively, the mating end 174 of the outer electrical contact 22 defines a plug (not shown) that is configured to be received within a socket (not shown) of the outer electrical contact 14 of the electrical plug 10.

The inner electrical contact 24 extends a length from a terminating end 184 to a mating end 186. The inner electrical contact 24 is held by the insulating member 166. Specifically, the inner electrical contact 24 is held within the contact channel 172 of the insulating member 166 such that the mating end 186 is held within the interior cavity 178 of the outer electrical contact 22. The outer electrical contact 22 thereby extends around the mating end 186 of the inner electrical contact 24. The insulating member 166 electrically insulates the inner electrical contact 24 from the outer electrical contact 22. The mating end 186 of the inner electrical contact 24 includes the pin 98 that is configured to be received within the receptacle 96 (FIGS. 3 and 6) of the inner electrical contact 16 of the electrical plug 10.

The terminating end 184 of the inner electrical contact 24 is electrically connected to one or more electrical traces (not shown) and/or one or more electrical contacts (not shown) of the printed circuit. In the exemplary embodiment, the inner electrical contact 24 is electrically connected to the electrical trace(s) and/or electrical contact(s) of the printed circuit via an intermediary contact 188 that engages the inner electrical contact 24 and the electrical trace(s) and/or electrical contact(s) of the printed circuit. Alternatively, the terminating end 184 of the inner electrical contact 24 is engaged with the electrical trace(s) and/or electrical contact(s) of the printed circuit to electrically connect the inner electrical contact 24 to the printed circuit.

An optional seal 190 is provided for sealing the passageway 158 at the end 138 of the housing 136. The seal 190 includes a contact channel 192 for receiving the intermediary contact 188 therethrough. The seal 190 may be fabricated from any material(s) that enable the seal 190 to facilitate sealing the passageway 158 at the end 138 of the housing 136, such as, but not limited to, rubber, silicone rubber, a polymer, glass, and/or the like. In the exemplary embodiment, the seal 190 is fabricated from a glass and is fused to the interior wall 162 of the housing 136. In addition or alternatively to being fused, the seal 190 may be secured within the passageway 158 at the end 138 of the housing 136 using any method, arrangement, structure, means, and/or the like, such as, but not limited to, using an adhesive, and interference-fit arrangement, and/or the like. In some embodiments, the seal 190 facilitates providing an electrical jack 18 that is compliant with IP68 for continuous immersion in water beyond one meter.

FIG. 6 is a cross-sectional view illustrating the electrical plug 10 mated with the electrical jack 18. When the electrical plug 10 and electrical jack 18 are mated together, the pin 98 of the inner electrical contact 24 of the electrical jack 18 is received within the receptacle 96 of the inner electrical contact 16 of the electrical plug 10. The mating ends 186 and 94 of the inner electrical contacts 24 and 16, respectively, are thus engaged and electrically connected. The plug 78 of the outer electrical contact 14 of the electrical plug 10 is received within the socket 80 of the outer electrical contact 22 of the electrical jack 18. The mating ends 174 and 74 of the outer electrical contacts 22 and 14, respectively, are thus engaged and electrically connected. The front face 112 of the outer electrical contact 22 of the electrical jack 18 is engaged with the side 108 of the compressible seal 34 of the electrical plug 10 to facilitate sealing the mating interfaces 20 (shown in FIG. 2) and 142 of the electrical plug 10 and electrical jack 18. In some embodiments, the engagement between the compressible seal 34 and the front face 112 of the outer electrical contact 22 of the electrical jack 18 facilitates providing an assembly of the electrical plug 10 and the electrical jack 18 that is compliant with IP68 for continuous immersion in water beyond one meter.

The ends 120 of the fingers 116 of the locking member 32 of the electrical plug 10 are received within the groove 182 of the outer electrical contact 22 of the electrical jack 18 to facilitate locking the electrical plug 10 and electrical jack 18 together. To unlock the locking member 32, the release collar 36 is moved along the central longitudinal axis 50 in the direction A such that the actuating arm 134 deflects the ends 120 of the fingers 116 radially outwardly from the central longitudinal axis 50 toward the interior wall 62 of the contact barrel 46. The electrical plug 10 and the electrical jack 18 can then be disengaged.

The electrical plug 10 and electrical jack 18 can be used in combination with another electrical plug (not shown) and another electrical jack (not shown) to facilitate preventing crossover connections. Specifically, the other electrical plug includes an inner electrical contact (not shown) that is a pin instead of having a receptacle. The other electrical jack includes an inner electrical contact (not shown) that includes a receptacle instead of being a pin. Accordingly, the electrical plug 10 cannot mate with the other electrical jack because the inner electrical contacts of both the electrical plug 10 and the other electrical jack are both receptacle contacts. Similarly, the electrical jack 18 cannot mate with the other electrical plug because the inner electrical contacts of both the electrical jack 18 and the other electrical plug are both pin contacts. The electrical plug 10 and electrical jack 18 therefore have a reversed polarity relative to the other electrical plug and other electrical jack. The use of the electrical plug 10 and electrical jack 18 in combination with the other electrical plug and other electrical jack may therefore prevent crossover connections. Specifically, the use of the electrical plug 10 and electrical jack 18 in combination with the other electrical plug and other electrical jack may prevent the electrical plug 10 and the electrical jack 18 from being mated with the wrong components.

The embodiments described and/or illustrated herein may provide an electrical plug and/or electrical jack that facilitate preventing crossover connections. For example, the embodiments described and/or illustrated herein may provide a connector that is similar to a DIN 1.0/2.3 connector and that facilitates preventing crossover connections. The embodiments described and/or illustrated herein provide an electrical plug and/or electrical jack that are compliant with IP68 for continuous immersion in water beyond one meter. For example, the embodiments described and/or illustrated herein may provide a connector that is similar to a DIN 1.0/2.3 connector and that is compliant with IP68 for continuous immersion in water beyond one meter.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Similarly, the terms "front", "rear", "top", "bottom", and "side" etc. in the claims are used merely as labels, and are not intended to impose orientational requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. An electrical connector comprising:

a housing;

an outer electrical contact held by the housing, the outer electrical contact comprising an interior cavity, a mounting end held by the housing, and a mating interface, the outer electrical contact being configured to mate with an electrical jack at the mating interface, a channel being defined between the housing and the outer electrical contact;

a locking member held within the channel between the housing and the outer electrical contact, the locking member being configured to engage the electrical jack; and an inner electrical contact having a mating end held within the interior cavity of the outer electrical contact, the outer electrical contact extending around the mating end of the inner electrical contact, the mating end of the inner electrical contact comprising a receptacle configured to receive an inner mating contact of the electrical jack.

2. The electrical connector according to claim 1, wherein the locking member comprises a spring.

3. The electrical connector according to claim 1, wherein the locking member comprises a base held by the housing and resilient fingers extending from the base toward the outer electrical contact.

4. The electrical connector according to claim 1, wherein the locking member comprises a base and resilient fingers extending from the base to ends, the ends of the resilient fingers being configured to engage an outer mating contact of the electrical jack.

5. The electrical connector according to claim 1, wherein the electrical connector is a first electrical connector and the electrical jack is a first electrical jack, further comprising a second electrical connector configured to mate with a second electrical jack, the second electrical connector having an inner electrical contact comprising a pin, the first and second electrical connectors being used in combination to prevent crossover connections.

6. The electrical connector according to claim 1, further comprising an insulating member held by the housing, the insulating member holding the inner electrical contact, the insulating member electrically insulating the inner electrical contact from the outer electrical contact.

7. The electrical connector according to claim 1, wherein the housing comprises a base and a crimp barrel extending from the base, the crimp barrel being configured to engage an outer conductor of a coaxial cable.

8. The electrical connector according to claim 1, wherein the outer electrical contact defines a plug that is configured to be received within a socket of the electrical jack.

9. An electrical connector comprising:

a housing;

an outer electrical contact held by the housing, the outer electrical contact comprising an interior cavity, a mounting end held by the housing, and a mating interface, the outer electrical contact being configured to mate with an electrical jack at the mating interface, a channel being defined between the housing and the outer electrical contact;

a locking member held within the channel between the housing and the outer electrical contact, the locking member being configured to engage the electrical jack;

a compressible seal held within the channel between the housing and the outer electrical contact, the compressible seal being configured to engage an outer mating contact of the electrical jack when the electrical connector and the electrical jack are mated together; and an inner electrical contact having a mating end held within the interior cavity of the outer electrical contact, the outer electrical contact extending around the mating end of the inner electrical contact.

10. The electrical connector according to claim 9, wherein the compressible seal comprises a radially inner surface that is engaged with the outer electrical contact.

11. The electrical connector according to claim 9, wherein the compressible seal extends around a mating end of the outer electrical contact.

12. The electrical connector according to claim 9, wherein the locking member comprises a base and resilient fingers extending from the base to ends, the ends of the resilient fingers being configured to engage an outer mating contact of the electrical jack.

13. The electrical connector according to claim 9, wherein the housing comprises a base and a crimp barrel extending from the base, the crimp barrel being configured to engage an outer conductor of a coaxial cable.

14. The electrical connector according to claim 9, wherein the outer electrical contact defines a plug that is configured to be received within a socket of the electrical jack.

* * * * *